US005886606A

United States Patent [19]

Tosaka et al.

[11] Patent Number: 5,886,606

[45] Date of Patent: Mar. 23, 1999

[54] CIRCUIT BREAKER

[75] Inventors: Hiroaki Tosaka; Koji Nomura; Akihiko Kohanawa, all of Kanagawa, Japan

[73] Assignee: Fuji Electric Co., Ltd., Kanagawa, Japan

[21] Appl. No.: 748,279

[22] Filed: Nov. 13, 1996

[30] Foreign Application Priority Data

Nov. 14, 1995 [JP] Japan ..... 7-319708

[51] Int. Cl.[6] ..... H01H 9/00

[52] U.S. Cl. ..... 335/172; 335/18; 335/173; 335/174; 361/42; 361/50

[58] Field of Search ..... 335/172, 18; 336/172–174; 361/42, 44, 50

[56] References Cited

U.S. PATENT DOCUMENTS

| | | | |
|---|---|---|---|
| 4,037,183 | 7/1977 | Gaskill | 335/6 |
| 4,394,636 | 7/1983 | Hiraku et al. | 336/172 |
| 4,939,491 | 7/1990 | Nissly et al. | 335/18 |
| 5,015,983 | 5/1991 | DeRosier et al. | 336/180 |
| 5,252,933 | 10/1993 | Kamino et al. | 335/172 |
| 5,276,416 | 1/1994 | Ozaki | 335/18 |

FOREIGN PATENT DOCUMENTS

Y2-5-26683 7/1993 Japan .

*Primary Examiner*—Lincoln Donovan
*Assistant Examiner*—Tuyen T. Nguyen
*Attorney, Agent, or Firm*—Pearne, Gordon, McCoy & Granger LLP

[57] ABSTRACT

In a circuit breaker, a power source current transformer (2) comprises: a secondary coil (6) arranged between two legs (1*a* and 1*b*) of a U-shaped part of a main circuit conductor (1), and an iron core (7) including an iron core leg (7*a*) which penetrates the secondary coil, and yokes (7*b* and 7*b*) which embrace the two legs (1*a* and 1*b*) of the U-shaped part of the main circuit conductor, the power source current transform supporting the current detecting means. As a result, the power source current transformer (2) is arranged compact inside the main circuit conductor (1), and the main circuit current, when flowing in each of the legs (1*a* and 1*b*) of the U-shaped part, produces the magnetic flux output acting on the secondary coil. Hence, even if the main circuit current is small, a great power source output can be obtained.

5 Claims, 2 Drawing Sheets

PRIOR ART

CIRCUIT BREAKER

BACKGROUND OF THE INVENTION

This invention relates to circuit breakers such as molded-case circuit breakers and earth leakage breakers, and more particularly to power source means in an over-current trip section.

A circuit breaker is well known in the art in which its main circuit conductor has a U-shaped portion, and a Hall element is arranged as current detecting means between both legs of the U-shaped portion to detect current flowing in the remain circuit conductor (cf. Japanese Utility Patent Publication No. 26683/1993). The convention al circuit breaker is as shown in FIG. 4. As shown in FIG. 4, a current path is formed between a power-source side terminal 8 and a load side terminal 9 which comprises a switching section including a stationary contactor 10 and a movable contactor 11, a flexible conductor 11 whose one end is connected to the movable contactor 12, and a main circuit conductor connected to the other end of the flexible conductor 12. The terminals 8 and 9 are connected to external conductors with screws 13.

The movable contactor 11 is opened and closed with an operating section 14. The operating section 14 comprises an operating handle 15, a latch 16, a latch receiver 17, a toggle link 18, and an opening and closing spring 19. When, with the circuit breaker in "on" state as shown in FIG. 4, the operating handle 15 is moved to the right in FIG. 4, the toggle link is collapsed with the aid of the opening and closing spring 19, so that the movable contact 11 is disengaged from the stationary contactor 10; that is, the application of current is suspended. When an excessively large current (over-current) flows in the main circuit conductor 1, a trip coil (not shown) is activated, so that the latch 16 is disengaged from the latch receiver 17; that is, the latch 16 is turn counterclockwise about a supporting pin 20. As a result, the toggle link 18 is collapsed, and the movable contactor 11 is therefore disengaged from the stationary contactor; that is, the flow of current is suspended.

A part of the main circuit conductor 1 is U-shaped. Between the two legs of the U-shaped part of the main circuit conductor, a Hall element 3 for detecting current flowing in the main circuit conductor 1 is provided separately in each phase. The Hall element 3 is mounted on a printed circuit board on which an electronic circuit for the over-current trip section is formed. The main circuit conductor 1 and the printed circuit board 5 are accommodated in a casing 21. When a current I flows in the main circuit conductor 1, the portions of the U-shaped part of the conductor 1 produce magnetic flux outputs $\phi_1$, $\phi_2$ and $\phi_3$ in the directions of the arrows. Inside the U-shaped part of the main circuit conductor, those magnetic flux outputs act on the Hall element 3 in the same direction. As a result, the Hall element produces a voltage (or Hall voltage) in a direction which is perpendicular to the directions of the current applied thereto in advance and the magnetic field. When the current I in the main circuit conductor 1 exceeds the rated value, then the Hall voltage also exceeds a predetermined value, as a result of which the electronic circuit applies a trip signal to the trip coil (not shown), so that the application of the current is interrupted.

In the circuit breaker shown in FIG. 4, a power source for the electronic circuit of the over-current trip section is obtained from the main circuit conductor. If, in the case where the power source is formed by a current transformer with the main circuit conductor as a primary conductor, it is intended to arrange the power source currents before and after the U-shaped part of the main circuit conductor, then the straight part of the main circuit conductor is unavoidably long, so that the resultant circuit breaker is elongated in the longitudinal direction as much. The power source current transformer of this type suffers from a problem that its output is insufficient in the case where the main circuit current is small.

SUMMARY OF THE INVENTION

In view of the foregoing, an object of the invention is to provide a circuit breaker having current detecting means between the legs of a U-shaped part of a main circuit conductor in which a power source current transformer of an over-current trip section is installed in a compact manner, and its output is sufficiently high.

In order to attain the above-noted and other objects, the present invention provides an improved arrangement for a circuit breaker wherein a power source current transformer is provided which includes secondary coil arranged between the two legs of the U-shaped part of the main circuit conductor, and an iron core including an iron leg which penetrates the secondary coil and yokes which embrace the two legs of the U-shaped part of the main circuit conductor. A current detecting means for detecting a current flowing in the main circuit conductor is supported by the power source current transform.

In the circuit breaker, the power source current transformer is provided at the U-shaped part of the main circuit conductor in such a manner that it is integral with the current detecting means, and therefore the required installation space can be made minimum. In addition, the magnetic flux outputs from the two legs of the U-shaped part of the main circuit conductor are collectively act on the iron core leg of the current transformer; that is, the magnetic flux output acts on the secondary coil which is twice as large as the magnetic flux output at the linear part of the main circuit conductor, and therefore the output is sufficiently high even when the current is small. The above-described current detecting means may be an air-core current transformer as well as the Hall element.

DETAILED DESCRIPTION OF THE PREFERRED EMBODIMENT

Figure 1:
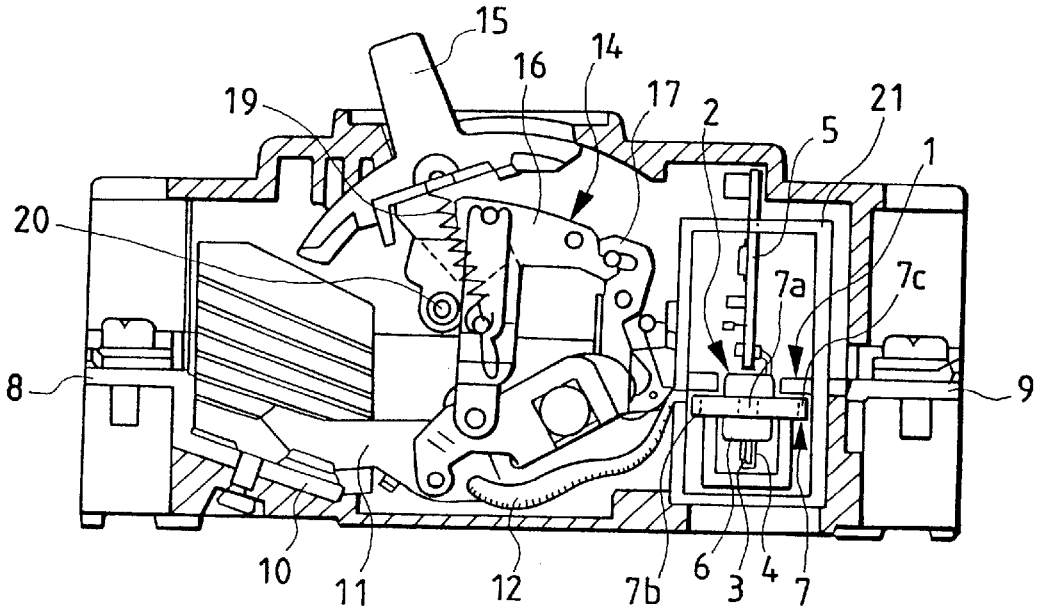
FIG. 1 is a longitudinal sectional view of a circuit breaker, which constitutes a preferred embodiment of the invention.
Figure 2:
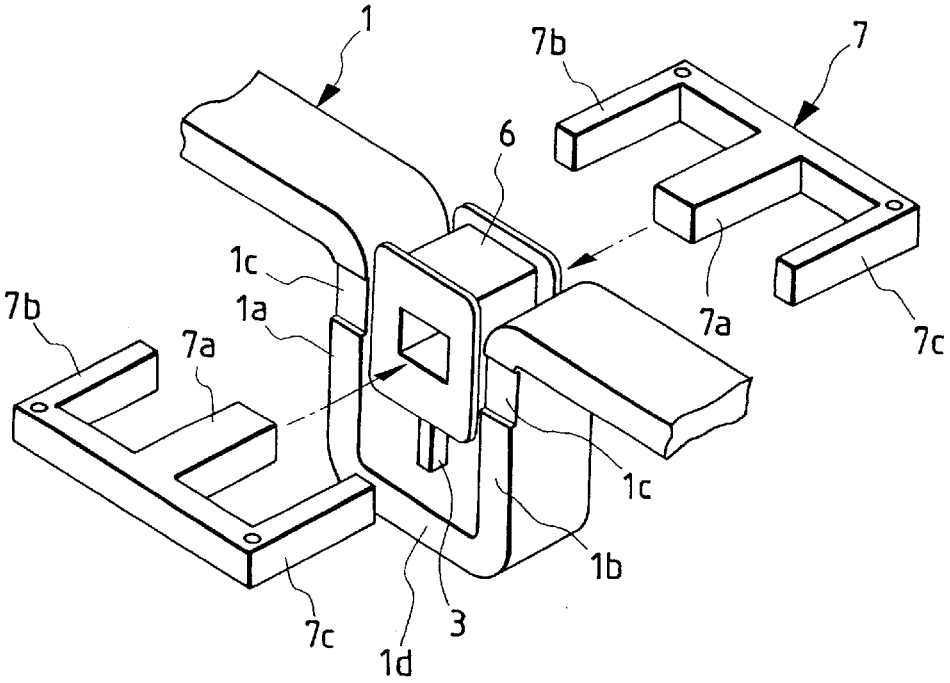
FIG. 2 is an exploded perspective view of a power source current transform former shown in FIG. 1.
Figure 3:
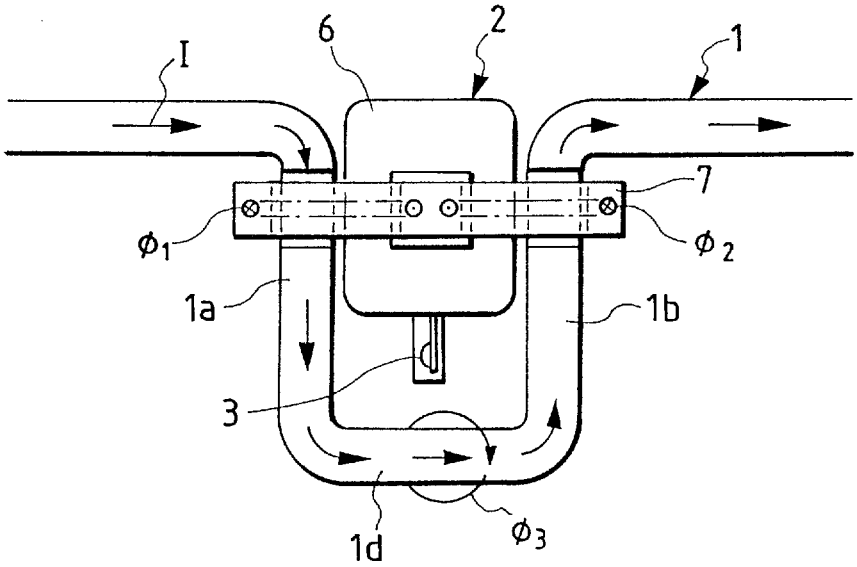
FIG. 3 is a side view for a description of magnetic flux outputs acting the power source current transformer.
Figure 4:
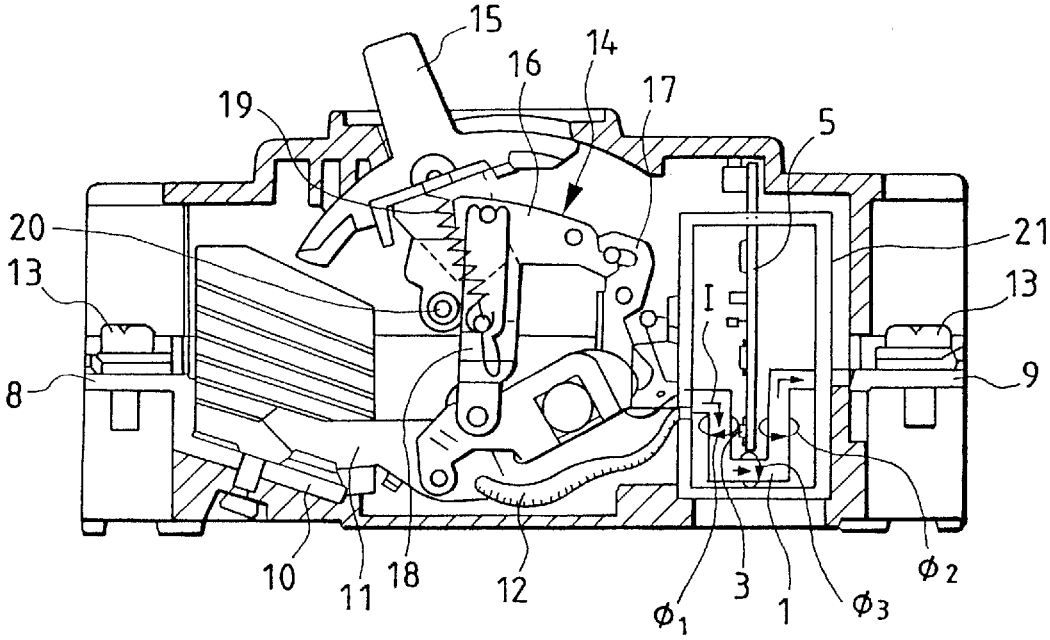
FIG. 4 is a longitudinal sectional view of a conventional circuit breaker.

FIG. 1 is a vertical sectional view showing a circuit breaker, which constitutes a preferred embodiment of the invention, FIG. 2 is an exploded perspective view of a power source current transformer; and FIG. 3 is a side view of the power source current transformer for description of the action of magnetic flux on a secondary coil. In those figures, parts corresponding functionally to those already described with reference to FIG. 4 are therefore designated by the same reference numerals or characters.

In FIG. 1, the main circuit conductor 1 of each phase is partially U-shaped. A power source current transformer 2 is provided at the U-shaped part of the main circuit conductor 1, to supply electric power to the electronic circuit of an over-current trip section, and current detecting means, namely, a Hall element 3 is provided between two legs 1*a* and 1*b* of the U-shaped part of the main circuit conductor in such a manner that the Hall element 3 is accommodated in a casing 4 located below the current transformer 2. A printed circuit board 5, on which an electronic circuit is formed which outputs a trip signal in response to an output voltage of the Hall element 3 detecting a current flowing in the main circuit conductor 1, is held vertical above the power source current transformer 2. The power source terminal section of the printed circuit board is connected to the output lines of the secondary coil 6 of the current transformer 2.

The current transformer 2, as shown in FIG. 2, comprises the secondary coil 6, and an iron core 7 made up of a pair of E-shaped iron core members. The secondary coil 6, as shown in FIG. 2, is provided between the two legs 1*a* and 1*b* of the U-shaped part of the main circuit conductor 1. The iron core 7 is formed by abutting the pair of E-shaped iron core members against each other in the secondary coil. More specifically, each of the E-shaped iron core members comprises an iron core leg 7*a* which is inserted into the secondary coil 6, and yokes 7*b* and 7*c* which embrace the two legs 1*a* and 1*b* of the U-shaped part of the main circuit conductors from outside. The right and left E-shaped iron core members are combined together with their yokes fastened through coupling plates (not shown) with screws. The current transformer 2 is supported with the iron core 7 fitted in grooves 1*c* formed in both side surfaces of the U-shaped part of the main circuit conductor 1.

When, in FIG. 3, a current I flows in the main circuit conductor in the directions of the arrows, the magnetic flux output $\phi_1$ of the current I which flows down the leg 1*a* (in FIG. 3), and the magnetic flux output $\phi_2$ of the current I which flows up the leg 1*b* (in FIG. 3) cross the secondary coil 6 in the same direction; that is, the secondary coil 6 receives the magnetic flux output which is twice as large as the magnetic flux output before or after the U-shaped part of the main circuit conductor, so that it produces a great output even if the current I is small. On the other hand, not only the above-described magnetic flux outputs $\phi_1$ and $\phi_2$ but also the magnetic flux outputs $\phi_3$ of the current flowing in the bent part 1*d* of the main circuit conductor 1 acts on the Hall element 3, so that a Hall voltage is produced according to the current I. When the current I becomes an over-current, the electronic circuit receiving the Hall voltage applies the trip signal to the trip coil in a delay time predetermined according to the magnitude of the current I, to open the circuit breaker. The current detecting element may be an air-core current transformer as well as the Hall element.

In the circuit breaker of the invention, the power source current transformer of the over-current trip section is provided at the U-shaped part of the main circuit conductor. Hence, when compared with the circuit breaker in which the current transformer is provided before or after the U-shaped part, the circuit breaker of the invention is small in length, and the magnetic flux output acts on the secondary coil which is twice as large as the magnetic flux output of the current flowing in the main circuit conductor, so that it produces a great output even if the current I is small. In addition, since the current detecting element is supported integral with the power source current transformer, the circuit breaker of the invention is simple in structure.

What is claimed is:

1. A circuit breaker comprising:

a main circuit conductor having a U-shaped part;

current detecting means for detecting a current flowing in said main circuit conductor;

a power source transformer including, a coil arranged between two legs of said U-shaped part of said main circuit conductor, and an iron core having an iron leg and a pair of yokes wherein said iron leg is disposed between said two legs of said U-shaped part and each of said leas of said U-shaped part is disposed between said iron leg and one of said yokes, and wherein said current detecting means is supported by said power source current transformer.

2. A circuit breaker as claimed in claim 1, wherein said current detecting means is arranged between the two legs of said U-shaped part of said main circuit conductor.

3. A circuit breaker as claimed in claim 2, wherein said current detecting means is a Hall element.

4. A circuit breaker as claimed in claim 2, wherein said current detecting means is an air-core current transformer.

5. A circuit breaker as claimed in claim 1, wherein said iron core includes a pair of E-shaped iron core members.

* * * * *

UNITED STATES PATENT AND TRADEMARK OFFICE

CERTIFICATE OF CORRECTION

PATENT NO. : 5,886,606

DATED : March 23, 1999

INVENTOR(S) : Tosaka et al.

It is certified that error appears in the above-indentified patent and that said Letters Patent is hereby corrected as shown below:

Column 1, Line 12, delete "remain" and insert --main--.

Column 1, Line 14, delete "convention al" and insert --conventional--.

Column 2, Line 48, delete "transform former" and insert --transformer--.

Signed and Sealed this

Twentieth Day of July, 1999

*Attest:*

*Attesting Officer*

Q. TODD DICKINSON

*Acting Commissioner of Patents and Trademarks*